US005775399A

United States Patent [19]

Shields, Jr.

[11] Patent Number: 5,775,399

[45] Date of Patent: Jul. 7, 1998

[54] LOUVERED BLIND WITH REMOVABLE CLOTH SHADES

[76] Inventor: John W. Shields, Jr., 1400 E. 79th St., Kansas City, Mo. 64131

[21] Appl. No.: 780,676

[22] Filed: Jan. 8, 1997

[51] Int. Cl.[6] ..... E06B 9/26

[52] U.S. Cl. ..... 160/176.1 R; 160/236; 49/74.1; 49/92.1; 49/403

[58] Field of Search ..... 160/236, 176.1 R, 160/177 R, 174 R, 173 R, 178.1 R; 49/74.1, 87.1, 92.1, 403

[56] References Cited

U.S. PATENT DOCUMENTS

| | | | |
|---|---|---|---|
| D. 133,609 | 3/1942 | Black . | |
| 1,789,655 | 1/1931 | Iwata | 160/173 R |
| 2,152,705 | 4/1939 | Mortimer . | |
| 2,187,121 | 1/1940 | Graves | 160/236 |
| 2,191,602 | 2/1940 | Watts | 160/173 R |
| 2,304,534 | 12/1942 | Burns | 160/173 R |
| 2,324,454 | 7/1943 | Huff | 49/87.1 X |
| 3,386,490 | 6/1968 | Kandel | 160/178.1 R |
| 3,490,515 | 1/1970 | Kandel | 160/178.1 R |
| 3,691,687 | 9/1972 | Economou . | |
| 4,049,038 | 9/1977 | Hyman et al. . | |
| 4,434,834 | 3/1984 | Ennes . | |
| 4,930,562 | 6/1990 | Goodman . | |
| 4,936,048 | 6/1990 | Ruggles . | |
| 4,951,729 | 8/1990 | Chi Yu | 160/236 X |
| 5,141,042 | 8/1992 | Schwaegerle . | |
| 5,238,042 | 8/1993 | Echeverria | 49/92.1 X |
| 5,303,507 | 4/1994 | Oille | 49/74.1 |
| 5,394,925 | 3/1995 | Ives . | |

*Primary Examiner*—David M. Purol

*Attorney, Agent, or Firm*—Hovey, Williams, Timmons & Collins

[57] ABSTRACT

A louvered blind (10) including an outer frame (12) and a plurality of louvers (14) mounted within the frame is disclosed. Each louver includes a removable cloth shade (26) and an improved support assembly (28) for supporting the shade within the frame. Each shade includes front and rear slat-receiving channels (33,35). Each support assembly includes front and rear support slats (38,40) that are each removably received within one of the slat-receiving channels (33,35) and a pair of louver caps (42,44) that are attached within the frame. Each louver cap includes a pair of elongated mounting slots (58,60) formed therein that receive the ends of the support slats and that permit the distance between the support slats to be selectively adjusted for facilitating reattachment of the shades to the support assemblies after the shades have been cleaned.

16 Claims, 2 Drawing Sheets

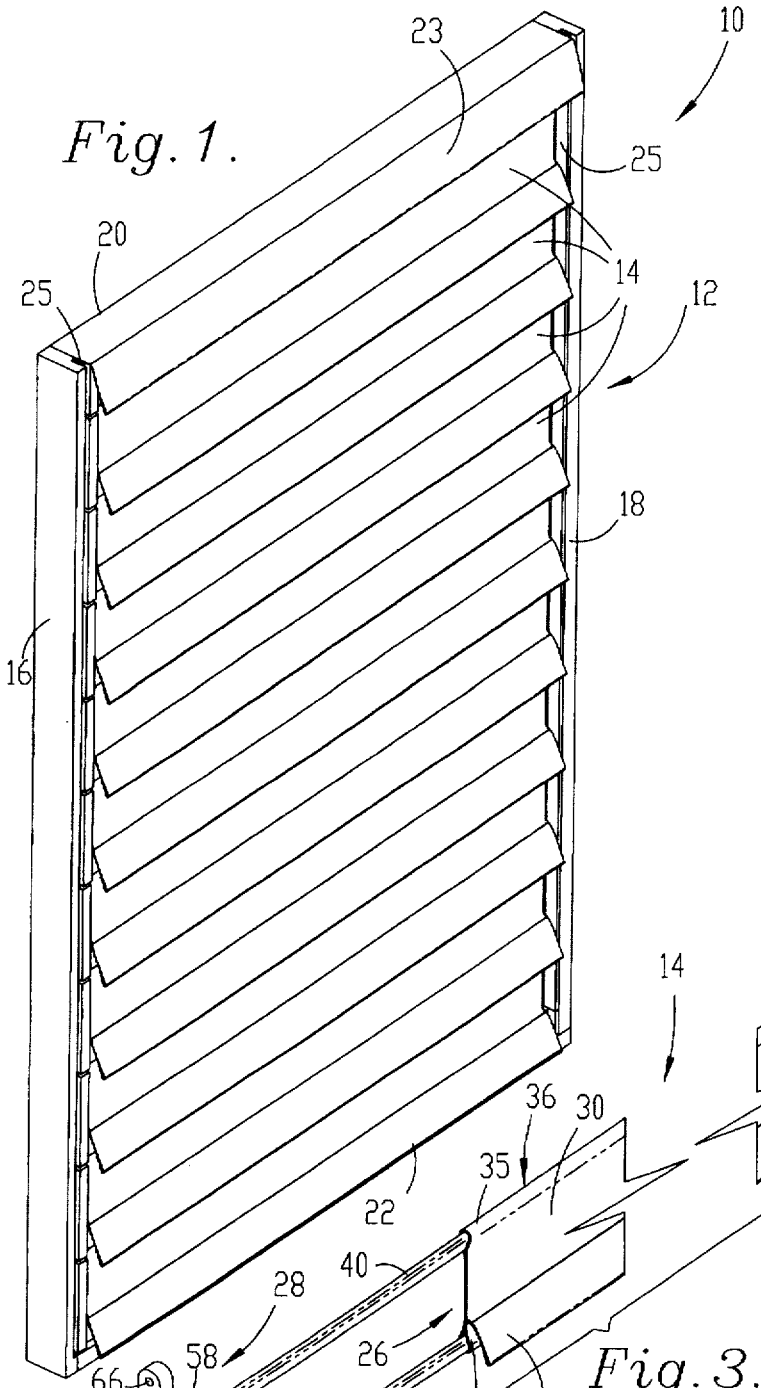
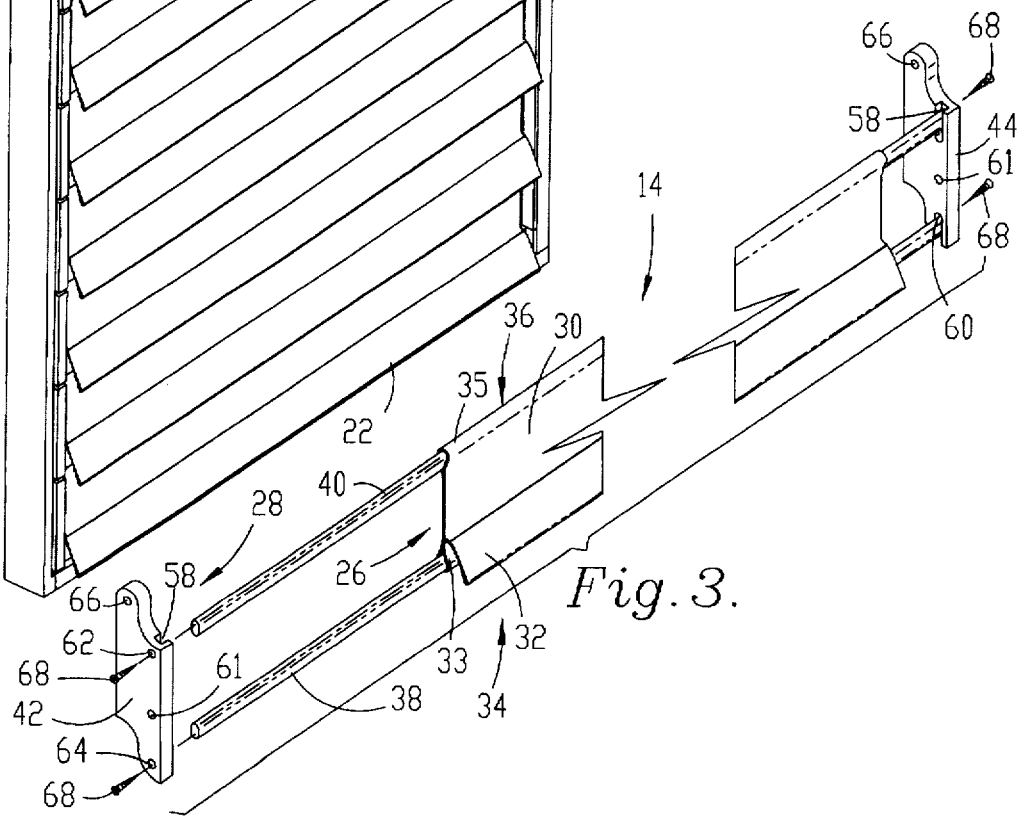
Fig. 3.

LOUVERED BLIND WITH REMOVABLE CLOTH SHADES

BACKGROUND OF THE INVENTION

1. Field of the Invention

The present invention relates to window or door blinds. More particularly, the invention relates to a louvered blind with removable cloth shades and an improved support assembly for supporting each of the shades to the blind.

2. Description of the Prior Art

The louvers on conventional window and door blinds are typically formed from wood, metal, or plastic. Unfortunately, many consumers don't like these types of blinds because they offer limited design options.

Pleated or cellular shades formed from cloth offer greater design choices because they can be formed from different materials and in a variety of patterns. However, many consumers do not like the way cloth shades operate because they do not include individual louvers that can be rotated between opened and closed positions, but rather include a large cloth or fabric layer that extends over the entire front and back of the blind. Thus, cloth blinds must be raised when it is desired to open the blinds.

To achieve the desired look of cloth blinds while retaining the operating advantages of conventional louvered blinds, some manufacturers cover the louvers of conventional louvered blinds with cloth material. However, blinds constructed in this manner unnecessarily waste raw materials and are expensive because the louvers must first be formed from plastic, wood, or metal and then completely covered with cloth.

Another limitation of cloth-covered blinds is that the cloth layers cannot be easily removed from and reattached to the individual louvers for cleaning and/or replacement because the cloth layers are permanently attached to the underlying louvers. Thus, these blinds cannot be modified and therefore also offer limited design choices.

OBJECTS AND SUMMARY OF THE INVENTION

In view of the foregoing limitations of prior art window and door blinds, it is an object of the present invention to provide an improved window or door blind that combines the aesthetic qualities of cloth blinds with the operating advantages of conventional louvered blinds.

It is another object of the present invention to provide a blind having louvers with cloth coverings and improved support assemblies for supporting the cloth coverings to the louvers.

It is another object of the present invention to provide a blind having adjustment mechanism that permits its cloth coverings to be easily removed and reattached after cleaning even if the cloth coverings shrink during cleaning.

The present invention achieves these and other objects by providing blind having a frame and a plurality of spaced louvers mounted within the frame, with each of the louvers including a cloth shade and an improved support assembly for supporting its cloth shade to the louver. In preferred forms, the front and rear edges of each cloth shade include stitched slat-receiving channels. The front slat-receiving channel is positioned 1"–2" inside its front edge to form an overhanging flap portion that hangs downwardly from the front edge of the shade. When the louvers are opened, the overhanging flap portions hang downwardly over the openings between the louvers and limit the view from outside the blind while permitting some light to enter the room through the blind.

The preferred support assemblies each include a pair of support slats removably received within the slat-receiving channels of its shade. The support assemblies also each include a pair of louver caps that are removably attached to the ends of their support slats and that are mounted within the frame of the blind.

Advantageously, each louver cap includes a front and rear elongated mounting slot formed therein for receiving one end of each of its the support slats. The length of the front slot is approximately the same as the width of the support slats so that the support slat that fits therein is flush with the front edge of the louver cap. The length of the rear slot is approximately twice the width of the support slats so that the support slat that fits therein can be moved to various positions along the length of the slot. This permits the distance between the support slats to be adjusted for facilitating the reattachment of the cloth shades to the support assemblies even if the cloth shades have shrunk during cleaning.

BRIEF DESCRIPTION OF THE DRAWING FIGURES

A preferred embodiment of the present invention is described in detail below with reference to the attached drawing figures, wherein:

FIG. 1 is a perspective view of a blind constructed in accordance with a preferred embodiment of the invention with its louvers in their closed positions;

FIG. 3 is an exploded and partially fragmented view of one of the louvers showing the cloth shade and support assembly for the louver in more detail.

DETAILED DESCRIPTION OF THE PREFERRED EMBODIMENTS

Figure 2:
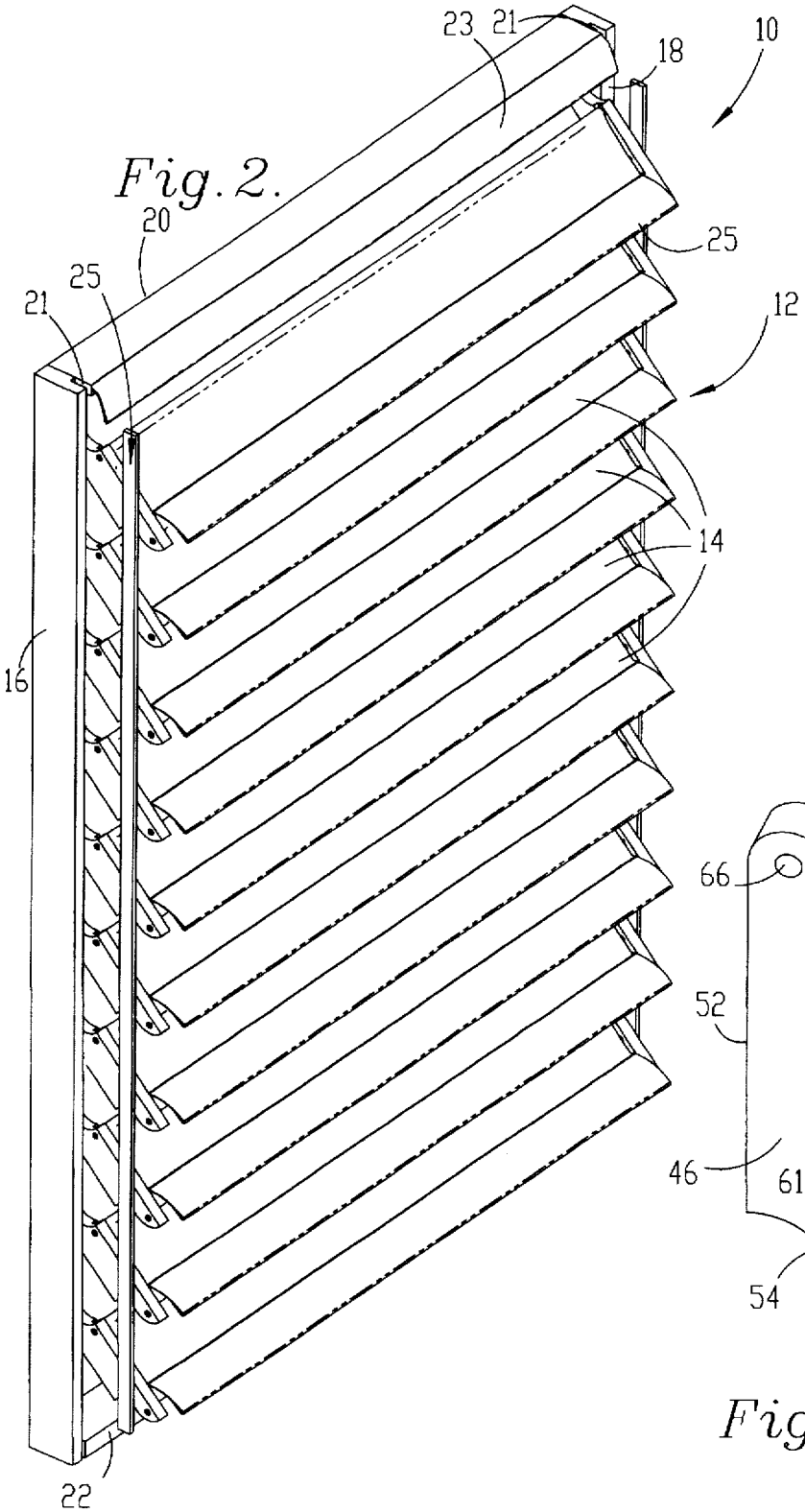
FIG. 2 is a perspective view of the blind with its louvers in their opened positions.

Turning now to the drawing figures and particularly FIGS. 1 and 2, a blind 10 constructed in accordance with a preferred embodiment of the invention is illustrated. The blind 10 is configured for fitting within or covering a conventional window or door and broadly includes an outer frame generally referred to by the numeral 12 and a plurality of louvers 14 mounted within the frame.

In more detail, the outer frame 12 is preferably rectangular in shape and includes a pair of spaced-apart, vertically extending side members 16,18 and a pair of spaced-apart, horizontally extending top and bottom members 20,22. As best illustrated in FIG. 2, each side member 16,18 has a generally L-shaped cross-section and includes an elongated recess 21 extending along the entire length of its front inside edge. As described in more detail below, these recesses 21 receive the guide rods 25 when the louvers are closed to permit the guide rods 25 to retract completely into the frame 12.

The ends of the inside face of the top member 20 include notches (not shown) formed therein. As described in more detail below, these notches allow the louver caps 42,44 of the uppermost louver to extend upwardly as they rotate to permit the louvers to completely open. The front edge of the inside face of the top member 20 also includes a channel (not shown) formed therein to permit the rear support slat of the uppermost louver to rotate upwardly to permit the louvers to completely open.

The side members 16,18 and top and bottom members 20,22 may be formed of any suitable material such as wood, metal, or plastic. The top member 20 may include a flap of decorative material 23 adhered thereto to serve as a valence for the blind.

The louvers 14 are pivotally mounted between the side members 16,18 of the frame 12 and are selectively shiftable to any position between a fully closed position illustrated in FIG. 1 and a fully opened position illustrated in FIG. 2. The louvers 14 may be either vertically-spaced relative to one another and horizontally-extending to form a horizontal blind as illustrated in the drawing figures or horizontally-spaced and vertically extending to form a vertical blind (not shown).

The louvers are preferably interconnected by elongated guide rods 25 that extend parallel to the side members 16,18 and that are attached to opposite ends of each of the louvers by conventional means such as screws or bolts. When the guide rods 25 are shifted upwardly, they move all of the louvers 14 towards their opened positions. The guide rods fit within the recesses 21 formed in the side members 16,18 when the louvers are shifted to their closed positions.

As best illustrated in FIG. 3, each louver 14 includes a shade 26 and a support assembly broadly referred to by the numeral 28 for supporting its shade 26 to the frame 12. The shades 26 are preferably formed of flexible fabric or cloth material. The support assemblies 28 are preferably formed from wood, plastic or other suitable material.

Each cloth shade 26 includes a base portion 30 and an overhanging flap portion 32. The base portion 30, which is preferably formed from two pieces of cloth that are sewn together, is generally rectangular in shape and presents a pair of opposed, elongated front and rear edges 34,36. Slat-receiving channels 33,35 are formed in the front and rear edges of each shade by spaced rows of stitching that run horizontal to the front and rear edges of the shade. The front slat-receiving channel 33 is preferably positioned 1"–2" inside its front edge 34 to form the overhanging flap portion 32. The overhanging flap portions 32 hang downwardly from the front edges of the shades when the louvers are opened to limit the view from outside the blind while permitting some light to enter the room through the blind.

Returning to FIG. 3, the support assemblies 28 for the shades 26 each includes front and rear elongated support slats 38,40 and left and right side louver caps 42,44. The support slats 38,40 are preferably rectangular and flat in cross-section and are preferably approximately 25"–30" in length but may also be formed of other desired lengths. The support slats 38,40 may be formed of any suitable material such as wood, metal or plastic.

Figure 4:
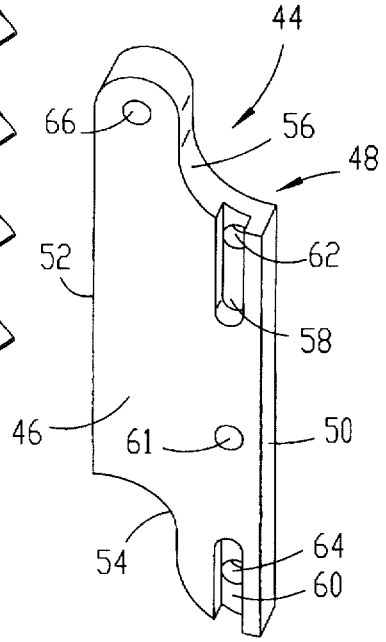
FIG. 4 is an enlarged perspective view of one of the louver caps of a support assembly.

As best illustrated in FIG. 4, each louver cap presents generally planar inner and outer faces 46,48, generally straight upper and lower edges 50,52, and serpentine shaped front and rear edges 54,56. The inner face 46 of each louver cap includes a pair of elongated mounting slots 58,60 formed therein that extend generally parallel to the upper and lower edges 50,52. A pair of screw or bolt holes 62,64 may be formed between the inner and outer faces 46,48, adjacent the edge 50 with each hole being in alignment with one of the mounting slots 58,60. Each louver cap also includes a screw or bolt hole 61 for attaching the guide rods 25 thereto and a screw or bolt hole 66 centered in the uppermost part of rear top edge 56 for attaching the louver cap to its respective side member 16,18.

Returning to FIG. 3, each louver 14 is assembled by first inserting the support slats 38,40 through the slat-receiving channels 33,35 of their respective shade 26. Specifically, the front support slat 38 is removably inserted through the front slat-receiving channel 33 and the rear support slat 40 is inserted through the rear slat-receiving channel 35. Then, the slats 38,40 are attached between their respective louver caps 42,44 by sliding the ends of the support slats into the mounting slots 58,60. Once the slats 38,40 are positioned in the mounting slots 58,60, they can be secured therein by screws or bolts 68 threaded through the holes 62,64. Other holes may be formed in the mounting slots 58,60 to permit the position of the slats to be moved and attached anywhere along the length of the mounting slots.

Since the support slats 38,40 are rectangular and flat in cross-section rather than circular, they resist twisting of the louvers about the longitudinal axis of the louvers. This results in assembled louvers that are stronger and more rigid than conventional louvers.

If the cloth shades are to be replaced while the louver caps 42,44 are attached within the frame 12, the rear slats 40 should be slid as far forward as possible into the rear slots 58 first. Next, the front slats 38 should be slid into the front slots 60. Then the rear slats 40 can be slid back until the cloth shades are stretched properly between the slats 38,40.

These steps can be easily reversed to remove the shades 26 from their respective support assemblies 28 for cleaning or replacing the shades. Advantageously, when the screws 68 are removed, the support slats 38,40 can be moved along the length of the mounting slots 58,60 to selectively adjust the distance between the support slats 38,40. Then, when the desired spacing is achieved, the screws 68 can be re-threaded into the ends of the slats 38,40 through the holes 62,64 or other holes formed in the mounting slots 58,60. This facilitates the reattachment of the shades to the blind even if the shades have shrunk during cleaning.

Once assembled, the louvers 14 are mounted within the frame 12 by placing the louver caps 42,44 between the side members 16,18 and threading screws or bolts through the holes 66 in the louver caps and into the side members 16,18. The guide rods 25 are then attached to the louvers to interconnect the louvers.

Although the invention has been described with reference to the preferred embodiment illustrated in the attached drawing figures, it is noted that equivalents may be employed and substitutions made herein without departing from the scope of the invention as recited in the claims.

Having thus described the preferred embodiment of the invention, what is claimed as new and desired to be protected by Letters Patent includes the following:

1. A window blind comprising:

a frame; and a plurality of spaced louvers mounted to said frame and selectively shiftable between opened and closed positions, each of said louvers including elongated shade having a pair of opposed side edges, and a support assembly for supporting said shade to said frame, said support assembly including a pair of support slats for attachment to said shade and adjusting means for selectively adjusting the distance between said support slats on each of said louvers for adjusting the distance between the opposed side edges of said shade for each of said louvers.

2. The blind as set forth in claim 1, said support assembly further including a pair of louver caps attached within said frame, said adjusting means including a pair of elongated mounting slots formed in each of said louver caps for receiving and supporting the ends of said support slats, said support slats being moveable to different positions within said mounting slots.

3. The blind as set forth in claim 1, said shade including a base portion and an overhanging flap portion.

4. The blind as set forth in claim 3, said shade being formed of cloth material.

5. The blind as set forth in claim 1, said frame including a pair of spaced-apart, vertically-extending side members, said louvers being mounted between said side members.

6. A window blind comprising:

an outer frame having a pair of spaced-apart, vertically extending side members; and a plurality of vertically-spaced, horizontally-extending louvers mounted between said side members and selectively shiftable between opened and closed positions, each of said louvers including an elongated shade presenting opposed top and bottom edges, said top and bottom edges each having a slat-receiving channel therein, and a support assembly for supporting said shade to said frame, said support assembly including a pair of support slats, each removably received within one of said slat-receiving channels of said shade, and a pair of louver caps each attached to one of said side members of said frame, each louver cap including an elongated mounting slot for receiving the ends of one of said support slats, said one support slat being moveable to different positions within said mounting slot.

7. The blind as set forth in claim 6, said shade including a base portion and an overhanging flap portion.

8. The blind as set forth in claim 6, said shade being formed of cloth material.

9. A louver for attachment to a blind, said louver comprising:

an elongated shade presenting opposed top and bottom edges, said top and bottom edges each having a slat-receiving channel therein; and a support assembly for supporting said shade to said frame, said support assembly including a pair of support slats, each removably received within one of said slat-receiving channels of said shade, and a pair of louver caps each attached to one of said side members of said frame, each louver cap including a pair of elongated mounting slots for receiving the ends of said support slats, said support slats being moveable to different positions within said mounting slots.

10. The louver as set forth in claim 9, said shade including a base portion and an overhanging flap portion.

11. The louver as set forth in claim 9, said shade being formed of cloth material.

12. A window blind comprising:

a frame; and a plurality of spaced louvers mounted within said frame and selectively shiftable between opened and closed positions, each of said louvers including an elongated shade having a pair of opposed side edges, and a support assembly for supporting said shade within said frame, said support assembly including a pair of support slats for attachment to said shade, a pair of louver caps for supporting said support slats to said frame, and adjusting means for adjusting the distance between said support slats on each of said louvers for adjusting the distance between the opposed side edges of said shade for each of said louvers.

13. The blind as set forth in claim 12, said adjusting means including a pair of elongated mounting slots formed in said louver cap for receiving said support slats, said support slats being moveable to different positions within said mounting slots.

14. The blind as set forth in claim 12, said shade including a base portion and an overhanging flap portion.

15. The blind as set forth in claim 14, said shade being formed of cloth material.

16. The blind as set forth in claim 12, said frame including a pair of spaced-apart, vertically-extending side members, said louvers being mounted between said side members.

* * * * *